US010478937B2

(12) United States Patent
Tang et al.

(10) Patent No.: US 10,478,937 B2
(45) Date of Patent: Nov. 19, 2019

(54) ACOUSTIC EMISSION MONITORING AND ENDPOINT FOR CHEMICAL MECHANICAL POLISHING

(71) Applicant: Applied Materials, Inc., Santa Clara, CA (US)

(72) Inventors: Jianshe Tang, Sunnyvale, CA (US); David Masayuki Ishikawa, Mountain View, CA (US); Benjamin Cherian, San Jose, CA (US); Jeonghoon Oh, San Jose, CA (US); Thomas H. Osterheld, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 723 days.

(21) Appl. No.: 14/639,859

(22) Filed: Mar. 5, 2015

(65) Prior Publication Data

US 2016/0256978 A1 Sep. 8, 2016

(51) Int. Cl.
*B24B 37/013* (2012.01)
*B24B 49/00* (2012.01)

(52) U.S. Cl.
CPC ..... *B24B 37/013* (2013.01); *B24B 49/003* (2013.01)

(58) Field of Classification Search
USPC ..... 156/345.12–345.16
See application file for complete search history.

(56) References Cited

U.S. PATENT DOCUMENTS 5,222,329 A 6/1993 Yu
5,240,552 A 8/1993 Yu et al.
5,245,794 A 9/1993 Salugsugan
5,399,234 A 3/1995 Yu et al.
5,425,137 A 6/1995 Mohan et al.
5,439,551 A 8/1995 Meikle et al.
5,904,609 A 5/1999 Fukuroda et al.
5,996,415 A * 12/1999 Stanke ..... G01N 29/041 374/119

(Continued)

FOREIGN PATENT DOCUMENTS

CN 1849198 10/2006
CN 1871504 11/2006

(Continued)

OTHER PUBLICATIONS

Ziola, S. et al. *Source Location in Thin Plates Using Cross-Correlation*. J. of Acoustic Society of America, Issue 90, vol. 5. Nov. 1991. (Dissertation, Naval Postgraduate School, Monterey California). 115 pages.

(Continued)

*Primary Examiner* — Rakesh K Dhingra
(74) *Attorney, Agent, or Firm* — Fish & Richardson P.C.

(57) ABSTRACT

A chemical mechanical polishing apparatus includes a platen to support a polishing pad, and an in-situ acoustic emission monitoring system including an acoustic emission sensor supported by the platen, a waveguide configured to extending through at least a portion of the polishing pad, and a processor to receive a signal from the acoustic emission sensor. The in-situ acoustic emission monitoring system is configured to detect acoustic events caused by deformation of the substrate and transmitted through the waveguide, and the processor is configured to determine a polishing endpoint based on the signal.

10 Claims, 4 Drawing Sheets

(56) References Cited

U.S. PATENT DOCUMENTS

| | | | | |
|---|---|---|---|---|
| 6,024,829 | A * | 2/2000 | Easter | B24B 1/04 156/345.12 |
| 6,159,073 | A | 12/2000 | Wiswesser et al. | |
| 6,722,946 | B2 | 4/2004 | Talieh et al. | |
| 6,910,942 | B1 | 6/2005 | Dornfeld et al. | |
| 7,112,960 | B2 | 9/2006 | Miller et al. | |
| 7,229,340 | B2 | 6/2007 | Hanawa et al. | |
| 7,300,332 | B2 | 11/2007 | Kobayashi et al. | |
| 7,513,818 | B2 | 4/2009 | Miller et al. | |
| 9,403,254 | B2 | 8/2016 | Hwang et al. | |
| 2002/0173223 | A1* | 11/2002 | Gitis | B24B 37/013 451/5 |
| 2003/0092269 | A1* | 5/2003 | Parikh | B24B 37/013 438/692 |
| 2006/0000807 | A1* | 1/2006 | Golzarian | B24B 37/013 216/88 |
| 2007/0218806 | A1* | 9/2007 | Kistler | B24B 37/013 451/5 |
| 2008/0004743 | A1 | 1/2008 | Goers et al. | |
| 2008/0207089 | A1 | 8/2008 | Lehman et al. | |
| 2011/0016975 | A1* | 1/2011 | Glaesemann | G01N 29/043 73/588 |
| 2012/0315826 | A1 | 12/2012 | Lu et al. | |
| 2013/0044004 | A1 | 2/2013 | Hwang et al. | |
| 2014/0027407 | A1 | 1/2014 | Deshpande et al. | |

FOREIGN PATENT DOCUMENTS

| | | |
|---|---|---|
| CN | 102245350 | 11/2011 |
| CN | 102956521 | 3/2013 |
| JP | 2008-286766 | 11/2008 |
| JP | 2010-179406 | 8/2010 |
| TW | 536454 | 6/2003 |
| TW | 200513349 | 4/2005 |
| TW | 200518878 | 6/2005 |
| TW | 201236813 | 9/2015 |
| WO | WO 2004/048038 | 6/2004 |
| WO | WO 2014/179241 | 11/2014 |

OTHER PUBLICATIONS

Tobias, A. *Acoustic-Emission Source Location in Two Dimensions by an Array of Three Sensors*. Non-Destructive Test., 9. Feb. 1976. pp. 9-12.

Tang, J. et al. *Low-K Dielectric Material Chemical Mechanical Polishing Process Monitoring Using Acoustic Emission*. MRS Symp. Proc. vol. 476. Apr. 1997. 6 pages.

International Search Report and Written Opinion in International Application No. PCT/US2016/016739, dated May 20, 2016, 15 pages.

Office Action in Taiwan Application No. 105106762, dated May 7, 2019, 10 pages (with English Search Report).

Office Action in Chinese Application No. 201680013942.0, dated Dec. 19, 2018, 15 pages (with English translation).

* cited by examiner

ACOUSTIC EMISSION MONITORING AND ENDPOINT FOR CHEMICAL MECHANICAL POLISHING

TECHNICAL FIELD

This disclosure relates to in-situ monitoring of chemical mechanical polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, the polishing endpoint usually cannot be determined merely as a function of polishing time.

In some systems, the substrate is monitored in-situ during polishing, e.g., by monitoring the torque required by a motor to rotate the platen or carrier head. Acoustic monitoring of polishing has also been proposed. However, existing monitoring techniques may not satisfy increasing demands of semiconductor device manufacturers.

SUMMARY

As noted above, acoustic monitoring of chemical mechanical polishing has been proposed. By placing the acoustic sensor in direct contact with the slurry or with a pad portion that is mechanically decoupled from the remainder of the polishing pad, signal attenuation can be reduced. This can provide more accurate monitoring or endpoint detection. This acoustic sensor can be used for endpoint detection in other polishing processes, e.g., to detect removal of a filler layer and exposure of an underlying layer.

In one aspect, a chemical mechanical polishing apparatus includes a platen to support a polishing pad, and an in-situ acoustic emission monitoring system including an acoustic emission sensor supported by the platen, a waveguide configured to extending through at least a portion of the polishing pad, and a processor to receive a signal from the acoustic emission sensor. The in-situ acoustic emission monitoring system is configured to detect acoustic events caused by deformation of the substrate and transmitted through the waveguide, and the processor is configured to determine a polishing endpoint based on the signal.

Implementations may include one or more of the following. The acoustic emission sensor may have an operating frequency between 125 kHz and 550 kHz. The processor may be configured to perform a Fourier transform on the signal to generate a frequency spectrum. The processor may be configured to monitor the frequency spectrum and to trigger a polishing endpoint if an intensity of a frequency component of the frequency spectrum crosses a threshold value.

In one aspect, a chemical mechanical polishing apparatus includes a platen to support a polishing pad, and an in-situ acoustic monitoring system to generate a signal. The in-situ acoustic monitoring system includes an acoustic emission sensor supported by the platen and a waveguide positioned to couple the acoustic emission sensor to slurry in a groove in the polishing pad.

Implementations may include one or more of the following. The apparatus may include the polishing pad. The polishing pad may have a polishing layer and a plurality of slurry-transport grooves in a polishing surface of the polishing layer, and the waveguide may extend through the polishing pad and into the groove. A tip of the waveguide may be positioned below the polishing surface. The polishing pad may include a polishing layer and a backing layer. The waveguide may extend through and contact the backing layer. An aperture may be formed in the backing layer and the waveguide may extend through the aperture. The in-situ acoustic monitoring system may include a plurality of parallel waveguides. A position of the waveguide may be vertically adjustable.

In another aspect, a chemical mechanical polishing apparatus includes a platen to support a polishing pad, and an in-situ acoustic monitoring system to generate a signal. The in-situ acoustic monitoring system includes an acoustic sensor supported by the platen, a body of polishing pad material that is mechanically decoupled from the polishing pad, and a waveguide that couples the acoustic sensor to the body of polishing pad material.

Implementations may include one or more of the following. The apparatus may include the polishing pad. The polishing pad material may be a same material as a polishing layer in the polishing pad. The body may be separated from the polishing pad by a gap. A seal may prevent slurry leakage through the gap. A position of the waveguide may be vertically adjustable. A flushing system may direct fluid into a recess below a tip of the waveguide.

In another aspect, a chemical mechanical polishing apparatus includes a platen to support a polishing pad, and a pad cord support configured to hold a cord of polishing material in an aperture in the polishing pad.

Implementations may include one or more of the following. The pad cord support may include a feed reel and a take-up reel, and the pad cord support is configured to guide the pad cord from the feed reel to the take-up reel. An in-situ acoustic monitoring system may generate a signal. The in-situ acoustic monitoring system may include an acoustic sensor supported by the platen, and a waveguide that couples the acoustic sensor to a region below the pad cord. A flushing system may direct fluid into a region between the waveguide and the pad cord. A tip of the waveguide may have a slot to receive the pad cord. The cord may be separated from the polishing pad by a gap.

In another aspect, a chemical mechanical polishing apparatus includes a platen to support a polishing pad, an in-situ acoustic monitoring system comprising a plurality of acoustic sensors supported by the platen at a plurality of different positions, and a controller configured to receive signals from the plurality of acoustic sensors and determine a position on the substrate of an acoustic event from the signals.

Implementations may include one or more of the following. The controller may be configured to determine a time difference between the acoustic event in the signals, and determine the position based on the time difference. The in-situ monitoring system may include at least three acoustic sensors and the controller may be configured to triangulate the position of the acoustic event. The acoustic event may be represented in the signals by a burst-type emission. The controller may be configured to determine a radial distance of the event from a center of the substrate. The controller may be configured to perform a Fast Fourier Transform (FFT) or a wavelet packet transform (WPT) on the signals. The plurality of acoustic sensors may be positioned at different radial distances from an axis of rotation of the platen. The plurality of acoustic sensors may be positioned at different angular positions around an axis of rotation of the platen.

In another aspect, a non-transitory computer-readable medium has stored thereon instructions, which, when executed by a processor, causes the processor to perform operations of the above apparatus.

Implementations can include one or more of the following potential advantages. An acoustic sensor can have a stronger signal. Exposure of an underlying layer can be detected more reliably. Polishing can be halted more reliably, and wafer-to-wafer uniformity can be improved.

The details of one or more embodiments are set forth in the accompanying drawings and the description below. Other aspects, features and advantages will be apparent from the description and drawings, and from the claims.

DESCRIPTION OF DRAWINGS

Like reference symbols in the various drawings indicate like elements.

DETAILED DESCRIPTION

In some semiconductor chip fabrication processes an overlying layer, e.g., metal, silicon oxide or polysilicon, is polished until an underlying layer, e.g., a dielectric, such as silicon oxide, silicon nitride or a high-K dielectric, is exposed. For some applications, when the underlying layer is exposed, the acoustic emissions from the substrate will change. The polishing endpoint can be determined by detecting this change in acoustic signal.

The acoustic emissions to be monitored can be caused by stress energy when the substrate material undergoes deformation, and the resulting acoustic spectrum is related to the material properties of the substrate. It may be noted that this acoustic effect is not the same as noise generated by friction of the substrate against the polishing pad (which is also sometimes referred to as an acoustic signal); it occurs in a significantly higher frequency range, e.g., 50 kHz to 1 MHz, than such frictional noise, and thus monitoring of the appropriate frequency range for acoustic emissions caused by substrate stress would not result from optimization the frequency range used for monitoring of frictional noise.

However, a potential problem with acoustic monitoring is transmission of the acoustic signal to the sensor. The polishing pad tends to dampen the acoustic signal. Thus, it would be advantageous to have the sensor in a position with low attenuation of the acoustic signal.

Figure 1:
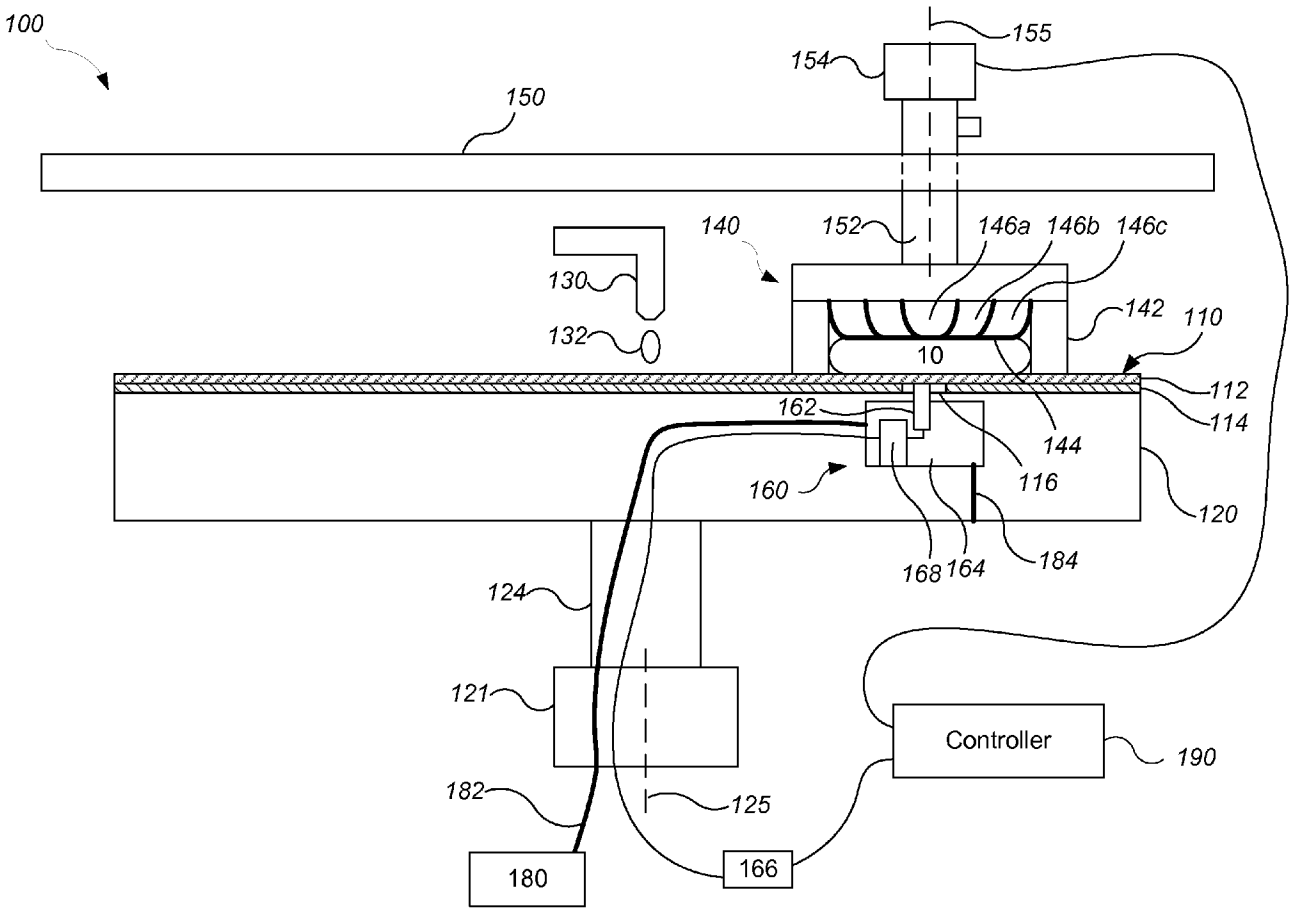
FIG. 1 illustrates a schematic cross-sectional view of an example of a polishing apparatus.

FIG. 1 illustrates an example of a polishing apparatus 100. The polishing apparatus 100 includes a rotatable disk-shaped platen 120 on which a polishing pad 110 is situated. The polishing pad 110 can be a two-layer polishing pad with an outer polishing layer 112 and a softer backing layer 114. The platen is operable to rotate about an axis 125. For example, a motor 121, e.g., a DC induction motor, can turn a drive shaft 124 to rotate the platen 120.

The polishing apparatus 100 can include a port 130 to dispense polishing liquid 132, such as abrasive slurry, onto the polishing pad 110 to the pad. The polishing apparatus can also include a polishing pad conditioner to abrade the polishing pad 110 to maintain the polishing pad 110 in a consistent abrasive state.

The polishing apparatus 100 includes at least one carrier head 140. The carrier head 140 is operable to hold a substrate 10 against the polishing pad 110. Each carrier head 140 can have independent control of the polishing parameters, for example pressure, associated with each respective substrate.

The carrier head 140 can include a retaining ring 142 to retain the substrate 10 below a flexible membrane 144. The carrier head 140 also includes one or more independently controllable pressurizable chambers defined by the membrane, e.g., three chambers **146*a*-146*c*, which can apply independently controllable pressurizes to associated zones on the flexible membrane 144 and thus on the substrate 10 (see FIG. 1). Although only three chambers are illustrated in FIG. 1** for ease of illustration, there could be one or two chambers, or four or more chambers, e.g., five chambers.

The carrier head 140 is suspended from a support structure 150, e.g., a carousel or track, and is connected by a drive shaft 152 to a carrier head rotation motor 154, e.g., a DC induction motor, so that the carrier head can rotate about an axis 155. Optionally each carrier head 140 can oscillate laterally, e.g., on sliders on the carousel 150, or by rotational oscillation of the carousel itself, or by sliding along the track. In typical operation, the platen is rotated about its central axis 125, and each carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently.

A controller 190, such as a programmable computer, is connected to the motors 121, 154 to control the rotation rate of the platen 120 and carrier head 140. For example, each motor can include an encoder that measures the rotation rate of the associated drive shaft. A feedback control circuit, which could be in the motor itself, part of the controller, or a separate circuit, receives the measured rotation rate from the encoder and adjusts the current supplied to the motor to ensure that the rotation rate of the drive shaft matches at a rotation rate received from the controller.

The polishing apparatus 100 includes at least one in-situ acoustic monitoring system 160. The in-situ acoustic monitoring system 160 includes one or more acoustic emission sensors 162. Each acoustic emission sensor can be installed at one or more locations on the upper platen 120. In particular, the in-situ acoustic monitoring system can be configured to detect acoustic emissions caused by stress energy when the material of the substrate 10 undergoes deformation.

A position sensor, e.g., an optical interrupter connected to the rim of the platen or a rotary encoder, can be used to sense the angular position of the platen 120. This permits only portions of the signal measured when the sensor 162 is in proximity to the substrate, e.g., when the sensor 162 is below the carrier head or substrate, to be used in endpoint detection.

In the implementation shown in FIG. 1, the acoustic emission sensor 162 is positioned in a recess 164 in the platen 120 and is positioned to receive acoustic emissions from a side of the substrate closer to the polishing pad 110. The sensor 162 can be connected by circuitry 168 to a power supply and/or other signal processing electronics 166 through a rotary coupling, e.g., a mercury slip ring. The signal processing electronics 166 can be connected in turn to the controller 190. The signal from the sensor 162 can be amplified by a built-in internal amplifier with a gain of 40-60 dB. The signal from the sensor 162 can then be further amplified and filtered if necessary, and digitized through an A/D port to a high speed data acquisition board, e.g., in the electronics 166. Data from the sensor 162 can be recorded at 1 to 3 Mhz.

If positioned in the platen 120, the acoustic emission sensor 162 can be located at the center of the platen 120, e.g., at the axis of rotation 125, at the edge of the platen 120, or at a midpoint (e.g., 5 inches from the axis of rotation for a 20 inch diameter platen).

In some implementations, a gas can be directed into the recess 164. For example, a gas, e.g., air or nitrogen, can be directed from a pressure source 180, e.g., a pump or gas supply line, through a conduit 182 provided by tubing and/or a passage in the platen 120 into the recess 164. An exit port 184 can connect the recess 164 to the external environment and permit escape of the gas from the recess 164. The gas flow can pressurize the recess 164 to reduce leakage of slurry into recess 164 and/or purge slurry that leaks into the recess 164 out through the exit port 184 to reduce the likelihood of damage to the electronics or other components of the contamination of the sensor 162.

The acoustic emission sensor 162 can include a probe 170 that provides an acoustic waveguide for transmission of acoustic energy. The probe 170 can project above the top surface 128 of the platen 120 that supports the polishing pad 110. The probe 170 can be, for example, a needle-shaped body with a sharp tip (e.g., see FIG. 2), that extends from the main body of the sensor 162 into the polishing pad 110. Alternatively, the probe 170 can be a cylindrical body (e.g., see FIG. 5) with a blunt top end. The probe can be manufactured from any dense material and is ideally made from corrosion resistant stainless steel.

For the sensor portion to which the waveguide is coupled, commercially available acoustic emission sensors (such as Physical Acoustics Nano 30) with operating frequencies between 50 kHz and 1 MHz, e.g., between 125 kHz and 1 MHz, e.g., between 125 kHz and 550 kHz, can be used. The sensor can be attached to the distal end of the waveguide and held in place, e.g., with a clamp or by threaded connection to the platen 120.

Figure 2:
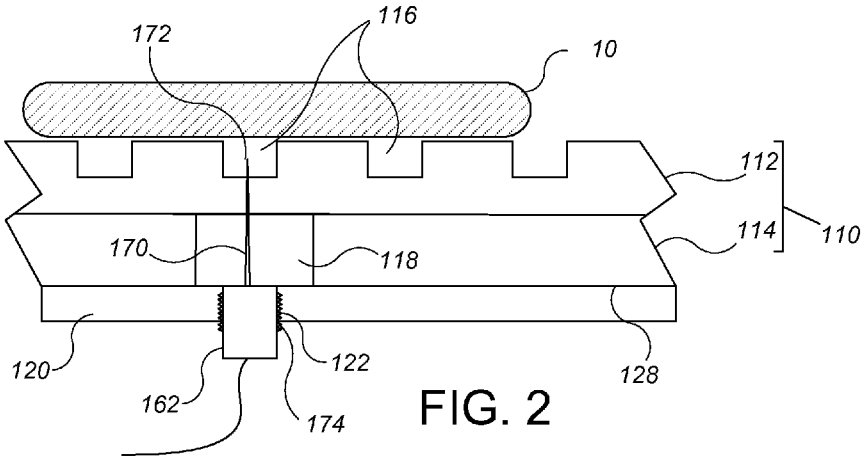
FIG. 2 illustrates a schematic cross-sectional view of an acoustic monitoring sensor with a probe that extends into a groove in a polishing pad.

Referring to FIG. 2, in some implementations, a plurality of slurry-transport grooves 116 are formed in the top surface of the polishing layer 112 of the polishing pad 110. The grooves 116 extend partially but not entirely through the thickness of the polishing layer 112. In the implementation shown in FIG. 2, the probe 170 extends through the polishing layer 172, e.g., through the thin portion of the polishing layer remaining below the groove 116, such that the tip 172 is positioned in one of the grooves 116. This permits the probe 170 to be directly sense the acoustic signals that propagate through the slurry present in the groove 116. As compared to a probe that simply extends into the polishing layer, this can improve the coupling of the acoustic emission sensor to the acoustic emissions from the substrate 10.

The tip 172 of the probe 170 should be positioned sufficiently low in the groove 116 that the tip does not contact the substrate 10 when the polishing pad 110 is compressed by the substrate 10.

In some implementations, the vertical position of the tip 172 of the probe is adjustable. This permits the vertical position of the sensing tip 172 to be precisely positioned with respect to the bottom of the grooves of the polishing pad 110. For example, the acoustic emission sensor 162 can include a cylindrical body that fits into an aperture through a portion of the platen 120. Threads 174 on the outer surface of the body can engage threads 122 on the inner surface of the aperture in the platen 120, so that adjustment of the vertical position of the tip 172 can accomplished by rotation of the body. However, another mechanism for vertical adjustment could be used, such as a piezoelectric actuator. The vertical positioning of the probe tip 172 can be combined with the implementation shown in FIGS. 2-4.

The probe 170 can extend through and contact the backing layer 114. Alternatively, an aperture 118 can be formed in the backing layer 114 so that the probe 170 extends through the aperture 118 and is not in direct contact with the backing layer 114. Using a thin needle-like probe 170 that punctures the polishing layer 112 can effectively keep the polishing layer 112 sealed and reduce leakage of slurry through the aperture created by the probe 170. In addition, the waveguide can penetrate the backing layer 114 without mechanically compromising the physical properties of the backing layer 114.

Figure 3:
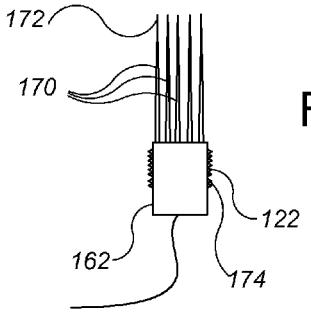
FIG. 3 illustrates a schematic cross-sectional view of an acoustic monitoring sensor with a plurality of probes.

Since alignment of the probe 170 to the groove 116 may be difficult, as shown in FIG. 3, the acoustic emission sensor 162 can include a plurality of probes 170. For example, the probes can be a plurality of parallel needles. Assuming the probes 170 extend across a region at least equal to the pitch between the grooves 116, when the polishing pad is placed on the platen 120, at least one of the tips 172 of the probes 170 should be positioned in a groove 116.

Figure 4:
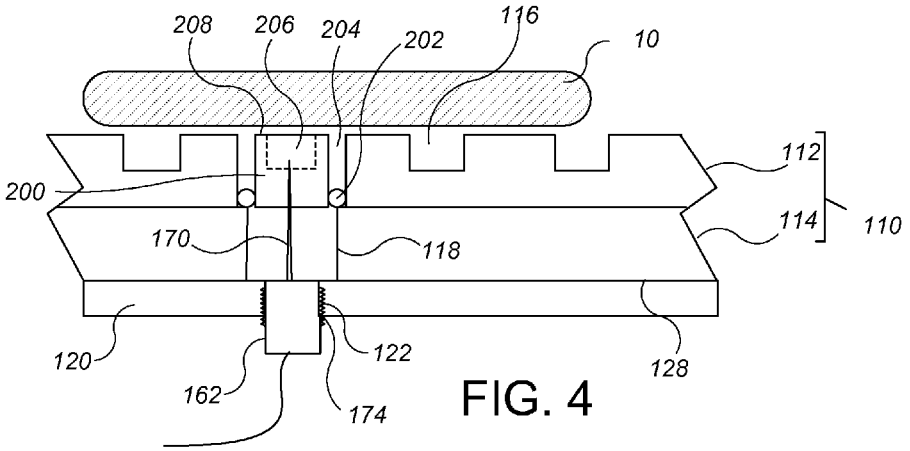
FIG. 4 illustrates a schematic cross-sectional view of an acoustic monitoring sensor with a probe that extends into a pad segment.

Referring to FIG. 4, in some implementations, the probe 170 of the acoustic emission sensor 162 extends into a body 200 with a top surface 208 that is configured to contact the bottom of the substrate 10 but is mechanically separated from the remainder of the polishing pad 110 by a gap 204. The body 200 can be formed of the same material as the polishing layer 112. The body can have the same thickness as the polishing layer 112. The body can be about 10 mm to 50 mm across. The body 200 can be circular (from a top viewed of the polishing pad), rectangular or another shape.

This configuration permits the probe 170 to receive acoustic signals through a body 200 that is direct contact with the substrate. However, by mechanically separating the body 200 from the polishing 110, the body 200 generally moves without restraint by the surrounding polishing pad 110. Thus, the body 200 can be considered substantially mechanically decoupled from the remainder of the polishing pad 110. This can improve transmission of the acoustic signal to the sensor 162.

Optionally, a recess 206 can be formed in the top surface of the body 200, and the probe 170 can extend through the body 200 into the recess 206. The recess 206 can fill with slurry, permitting the acoustic emission sensor 162 to directly sense the acoustic signals that propagate through the slurry present in the recess 206.

As noted above, the body 200 can be of the same material as the remainder of the polishing pad, e.g., porous polyurethane. The body 200 can be opaque. On the other hand, in some implementations, the polishing system 100 also includes an in-situ optical monitoring system. In this case the body 200 can be a transparent window through which the optical monitoring system directs a light beam.

Optionally, a seal 202, e.g., an O-ring, can be used to prevent slurry leakage through the gap 204 between the body 200 and the polishing pad 110. The seal 202 can be sufficiently flexible that the deflections of the pad 110 are not transmitted to the body 200, thus keeping the body 200 substantially mechanically decoupled from the remainder of the polishing pad 110.

Figure 5:
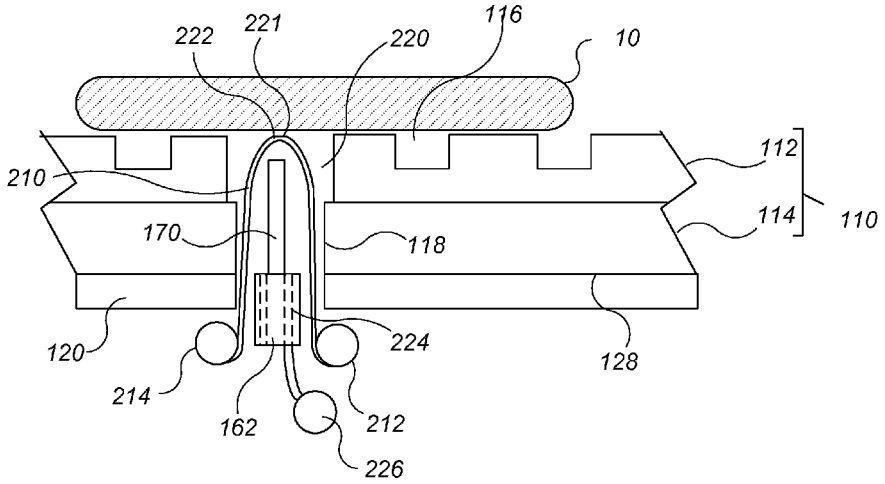
FIG. 5 illustrates a schematic cross-sectional view of an acoustic monitoring sensor with a movable cord.

Referring to FIG. 5, in some implementations, the body 200 of pad material is replaced with a cord 210 manufactured from pad material, e.g., the same material as the polishing layer 112. The cord 210 can be spooled from a feed reel 212 to a take-up reel 214. The cord 210 extends from the feed reel 212 up through an aperture 118 in the backing layer 114 and an aperture 220 in the polishing layer 112 to a portion 221 with a top surface 222 that is substantially coplanar with the stop surface of the polishing layer 112, and back through the apertures 118, 220 to the take-up reel 214. Although not illustrated, the cord 210 can pass through guide slots that maintain the portion 221 in a desired position, e.g., generally level with the polishing layer 112 and centered in the aperture 220.

In operation, a motor can periodically advance the take-up reel 214 to pull a fresh portion of the cord 210 from the feed reel 214. By providing a fresh portion of pad material over the sensor 162, this configuration can avoid pad wear at the sensing tip causing measurement drift.

The acoustic emission sensor 162 can also include a fluid purge port, e.g., one or more passages 224 through the body of the sensor 162. In operation, a fluid, e.g., a liquid such as water, can be directed from a fluid source 226 through the passage(s) 224 into the apertures 118 and 220. This can prevent slurry from accumulating in the apertures. In addition, the fluid can improve coupling acoustic coupling of the probe 170 to the substrate 10.

Figure 6:
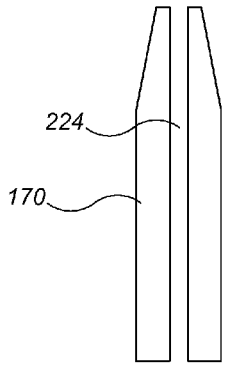
FIG. 6 illustrates a schematic cross-sectional view of a probe from an acoustic monitoring sensor.

Although FIG. 5 illustrates the passage 226 of the fluid purge port located in the lower body of the sensor 162, as shown in FIG. 6, in some implementations the passage 226 can extend through the probe 170, along the long axis of the probe 170. This permits fluid to be injected into the space closer to the cord 210, and can provide improved coupling acoustic coupling of the probe 170 to the substrate 10. In some implementations, the top end of the probe 170 includes a slot that acts as the guide to hold the portion 221 of the cord 210 in the desired position.

Turning now to the signal from the sensor 162 of any of the prior implementations, the signal, e.g., after amplification, preliminary filtering and digitization, can be subject to data processing, e.g., in the controller 190, for either endpoint detection or feedback or feedforward control.

In some implementations, a frequency analysis of the signal is performed. For example, a Fast Fourier Transform (FFT) can be performed on the signal to generate a frequency spectrum. A particular frequency band can be monitored, and if the intensity in the frequency band crosses a threshold value, this can indicate exposure of an underlying layer, which can be used to trigger endpoint. Alternatively, if the width of a local maxima or minima in a selected frequency range crosses a threshold value, this can indicate exposure of an underlying layer, which can be used to trigger endpoint. For example, for monitoring of polishing of interlayer dielectric (ILD) in a shallow trench isolation (STI), a frequency range of 225 kHz to 350 kHz can be monitored.

As another example, a wavelet packet transform (WPT) can be performed on the signal to decompose the signal into a low-frequency component and a high frequency component. The decomposition can be iterated if necessary to break the signal into smaller components. The intensity of one of the frequency components can be monitored, and if the intensity in the component crosses a threshold value, this can indicate exposure of an underlying layer, which can be used to trigger endpoint.

Figure 7:
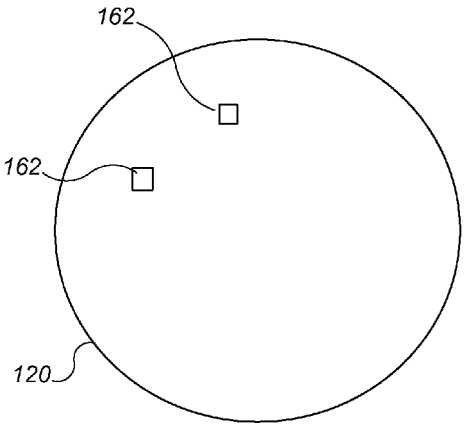
FIG. 7 illustrates a schematic top view of a platen having a plurality of acoustic monitoring sensors.

Referring to FIG. 7, in some implementations a plurality of sensors 162 can be installed in the platen 120. Each sensor 162 can be configured in the manner described for any of FIGS. 2-6. The signals from the sensors 162 can be used by the controller 190 to compute the positional distribution of acoustic emission events occurring on the substrate 10 during polishing. In some implementations, the plurality of sensors 162 can be positioned at different angular positions around the axis of rotation of the platen 120, but at the same radial distance from the axis of rotation. In some implementations, the plurality of sensors 162 are positioned at different radial distances from the axis of rotation of the platen 120, but at the same angular position. In some implementations, the plurality of sensors 162 are be positioned at different angular positions around and different radial distances from the axis of rotation of the platen 120.

Figure 8:
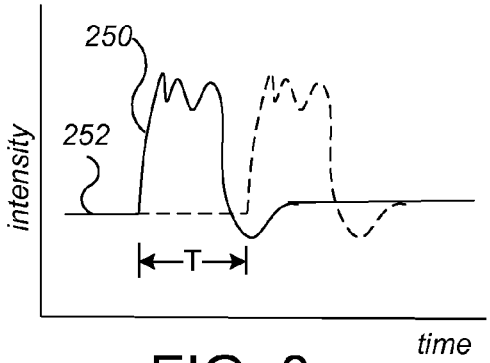
FIG. 8 illustrates signals from the plurality of acoustic monitoring sensors.

FIG. 8 is a graph 250 of signal intensity as a function of time from a sensor 162. Assuming that acoustic emissions from the substrate 10 are the result of discrete events on the substrate 10, a particular event should manifest as deviation 250, e.g. as a burst-type emission, from the background acoustic signal 252. Each deviation could have a different shape, but for particular deviation the signals received by the different sensors 162 should have substantially the same shape, albeit time shifted (shown in phantom) due to the difference in time needed for the signal to propagate from the location of the event to the sensor. The speed of acoustic emission wave propagation through slurry 132 is constant.

The time it takes for each sensor 162 to receive wave signals from particular events occurring on the polishing surface 112 is therefore proportional to the distance between the particular event location and sensor locations. Thus, the time at which each sensor 162 receives the acoustic signal indicating a particular event will depend on the distance of the sensor 162 to the location of the event and the speed of propagation of the acoustic signal.

The relative time difference T that each sensor receives an acoustic signal indicating the event can be determined, e.g., using cross-correlation of the signals from the sensors 162. This time difference T can be used to triangulate the approximate location of the acoustic event in the two-dimensional space between the sensors 162. Increasing the number of sensors 162 can improve accuracy the triangulation. Triangulation of acoustic signals using two or more sensors is described in "Source location in thin plates using cross-correlation," S. M. Ziola and M. R. Gorman, J. of Acoustic Society of America, 90 (5) (1991), and "Acoustic-Emission source location in two dimensions by an array of three sensors," Tobias, Non-Destructive Test., 9, pp. 9-12 (1976). Applying these techniques to CMP involves the fluid in the groves of the polishing pad—and more specifically the fluid 132 between the pad 110 and the substrate 10—serving as an isotropic medium for wave propagation.

Assuming the positions of the sensors 162 relative to the substrate 10 are known, e.g., using a motor encoder signal or an optical interrupter attached to the platen 120, the positions of the acoustic events on the substrate can be calculated, e.g., the radial distance of the event from the center of the substrate can be calculated. Determination of the position of a sensor relative to the substrate is discussed in U.S. Pat. No. 6,159,073, incorporated by reference.

Various process-meaningful acoustic events include micro-scratches, film transition break through, and film clearing. Various methods can be used to analyze the acoustic emission signal from the waveguide. Fourier transformation and other frequency analysis methods can be used to determine the peak frequencies occurring during polishing. Experimentally determined thresholds and monitoring within defined frequency ranges are used to identify expected and unexpected changes during polishing. Examples of expected changes include the sudden appearance of a peak frequency during transitions in film hardness. Examples of unexpected changes include problems with the consumable set (such as pad glazing or other process-drift-inducing machine health problems).

Figure 9:
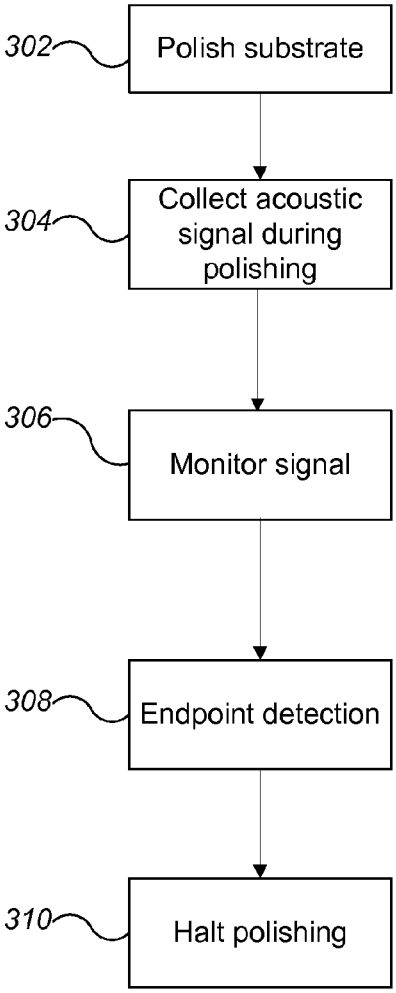
FIG. 9 is a flow chart illustrating a method of controlling polishing.

FIG. 9 illustrates a process for polishing a device substrate, e.g., after the threshold values have been determined experimentally. A device substrate is polished at the polishing station (302) and an acoustic signal is collected from the in-situ acoustic monitoring system (304).

The signal is monitored to detect exposure of the underlying layer (306). For example, a specific frequency range can be monitored, and the intensity can be monitored and compared to a threshold value.

Detection of the polishing endpoint triggers halting of the polishing (310), although polishing can continue for a predetermined amount of time after endpoint trigger. Alternatively or in addition, the data collected and/or the endpoint detection time can be fed forward to control processing of the substrate in a subsequent processing operation, e.g., polishing at a subsequent station, or can be fed back to control processing of a subsequent substrate at the same polishing station.

Implementations and all of the functional operations described in this specification can be implemented in digital electronic circuitry, or in computer software, firmware, or hardware, including the structural means disclosed in this specification and structural equivalents thereof, or in combinations of them. Implementations described herein can be implemented as one or more non-transitory computer program products, i.e., one or more computer programs tangibly embodied in a machine readable storage device, for execution by, or to control the operation of, data processing apparatus, e.g., a programmable processor, a computer, or multiple processors or computers.

A computer program (also known as a program, software, software application, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. Processors suitable for the execution of a computer program include, by way of example, both general and special purpose microprocessors, and any one or more processors of any kind of digital computer.

Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

The above described polishing apparatus and methods can be applied in a variety of polishing systems. Either the polishing pad, or the carrier head, or both can move to provide relative motion between the polishing surface and the wafer. For example, the platen may orbit rather than rotate. The polishing pad can be a circular (or some other shape) pad secured to the platen. Some aspects of the endpoint detection system may be applicable to linear polishing systems (e.g., where the polishing pad is a continuous or a reel-to-reel belt that moves linearly). The polishing layer can be a standard (for example, polyurethane with or without fillers) polishing material, a soft material, or a fixed-abrasive material. Terms of relative positioning are used; it should be understood that the polishing surface and wafer can be held in a vertical orientation or some other orientations.

While this specification contains many specifics, these should not be construed as limitations on the scope of what may be claimed, but rather as descriptions of features that may be specific to particular embodiments of particular inventions. In some implementations, the method could be applied to other combinations of overlying and underlying materials, and to signals from other sorts of in-situ monitoring systems, e.g., optical monitoring or eddy current monitoring systems.

What is claimed is:

1. A chemical mechanical polishing apparatus, comprising:

a platen to support a polishing pad; and an in-situ acoustic monitoring system to generate a signal, the in-situ acoustic monitoring system including an acoustic emission sensor supported by the platen and an acoustic waveguide positioned to extend through the polishing pad such that the acoustic waveguide has a first end coupled to the acoustic emission sensor and a second end in a groove in the polishing pad so that the acoustic emission sensor receives acoustic signals that propagate through slurry in the groove in the polishing pad.

2. The apparatus of claim 1, comprising the polishing pad, the polishing pad having a polishing layer and a plurality of slurry-transport grooves in a polishing surface of the polishing layer, the groove being one of the plurality of slurry-transport grooves.

3. The apparatus of claim 2, wherein a tip of the waveguide is positioned below the polishing surface.

4. The apparatus of claim 2, wherein the polishing pad comprises a backing layer between the polishing layer and the platen.

5. The apparatus of claim 4, wherein backing layer has an aperture therethrough and the waveguide extends through the aperture.

6. The apparatus of claim 2, wherein the waveguide punctures the polishing layer in a substantially sealed manner.

7. The apparatus of claim 1, wherein the in-situ acoustic monitoring system comprises a plurality of parallel waveguides.

8. The apparatus of claim 1, wherein a position of the waveguide is vertically adjustable.

9. The apparatus of claim 1, wherein the waveguide comprises an elongated body extending substantially perpendicular to a top surface of the platen.

10. The apparatus of claim 9, wherein the waveguide comprises needle-shaped body.

* * * * *